United States Patent [19]

Dostourian

[11] 4,214,686

[45] Jul. 29, 1980

[54] KEEPER FOR LOAD CARRYING EQUIPMENT

[75] Inventor: Harry Dostourian, West Boylston, Mass.

[73] Assignee: The United States of America as represented by the Secretary of the Army, Washington, D.C.

[21] Appl. No.: 19,791

[22] Filed: Mar. 12, 1979

[51] Int. Cl.[2] ..... A45F 5/02

[52] U.S. Cl. ..... 224/252; 24/3 R; 24/260; 224/269

[58] Field of Search ..... 224/271, 252, 232, 234, 224/269, 194, 195, 193, 192, 191; 24/3 R, 3 G, 3 K, 3 L, 3 H, 3 F, 3 J, 3 D, 241 SL, 237, 238, 222, 260

[56] References Cited

U.S. PATENT DOCUMENTS

| | | | |
|---|---|---|---|
| 996,340 | 6/1911 | Hopkins | 24/3 D UX |
| 1,113,590 | 10/1914 | Williamson | 224/252 |
| 1,589,074 | 6/1926 | Harris | 224/252 X |
| 1,806,477 | 5/1931 | Lloyd et al. | 24/3 F X |
| 2,789,742 | 4/1957 | De Salvo | 224/271 |
| 2,823,434 | 2/1958 | Van Buren | 24/3 K |
| 2,869,198 | 1/1959 | Clevett | 24/3 K |

*Primary Examiner*—Robert J. Spar
*Assistant Examiner*—Jerold M. Forsberg
*Attorney, Agent, or Firm*—Nathan Edelberg; Robert P. Gibson; Lawrence E. Labadini

[57] ABSTRACT

A keeper for detachably securing load carrying means to service belts such as those worn by the military. The keeper is constructed entirely of metallic wire of suitable diameter and strength, which is bent to form two substantially parallel loops having extensions thereof in the form of substantially parallel arms which along with the loops fit around a service belt, the free ends of the metallic wire being formed into ears which can pass between one pair of parallel arms and snap back behind these arms to lock the keeper. A latch, also made of the same type of wire as the keeper, slides along the arms to latch and unlatch the arms, as desired by the wearer, for maintaining the keeper in its locked condition or for permitting it to be readily unlocked when the wearer desires.

3 Claims, 2 Drawing Figures

KEEPER FOR LOAD CARRYING EQUIPMENT

The invention described herein may be manufactured, used, and licensed by or for the Government for governmental purposes without the payment to me of any royalty thereon.

BACKGROUND OF THE INVENTION

This invention relates to a keeper made of metallic wire for securely attaching load carrying equipment or the like to service belts made of webbing or other flexible material.

The Army has from time to time employed various types of devices for supporting load carrying equipment on a soldier's person. Examples of such devices include the pistol belt clips disclosed in U.S. Pats. Nos. 2,789,742 of J. V. DeSalvo and 2,869,198 of M. L. Clevett, Jr. Such belt clips have certain disadvantages, among which are relatively high costs and considerable weight added to the loads which must be carried by soldiers. Also, it has been found by experience in the field that bayonet type clips, such as that of U.S. Pat. No. 2,869,198, may be rather easily unlocked under certain field operation conditions with resulting losses of critically needed equipment or supplies, such as food, water, or ammunition being carried on a soldier's person.

An object of the invention is to provide a keeper device for load carrying equipment which is light in weight, yet sufficiently strong to support any normal load carrying equipment which may be designed to be attached to a service belt, and which is capable of easy locking and unlocking by deliberate action, but virtually incapable of accidental unlocking.

Another object of the invention is a keeper for load carrying equipment which is made entirely of metallic wire and is relatively inexpensive.

Other objects and advantages of the invention will be apparent from the following description when taken in connection with the accompanying drawings.

DESCRIPTION OF PREFERRED EMBODIMENT

Figure 1:
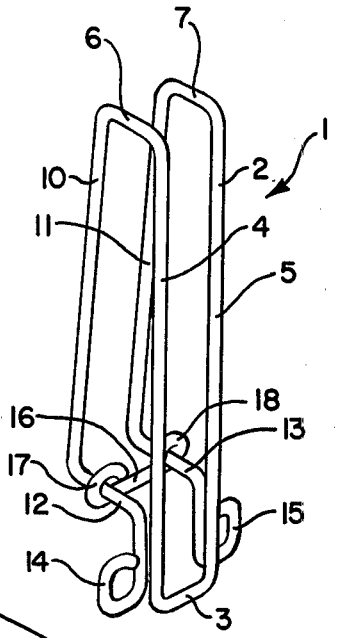

The invention is illustrated in the drawing wherein

Figure 2:
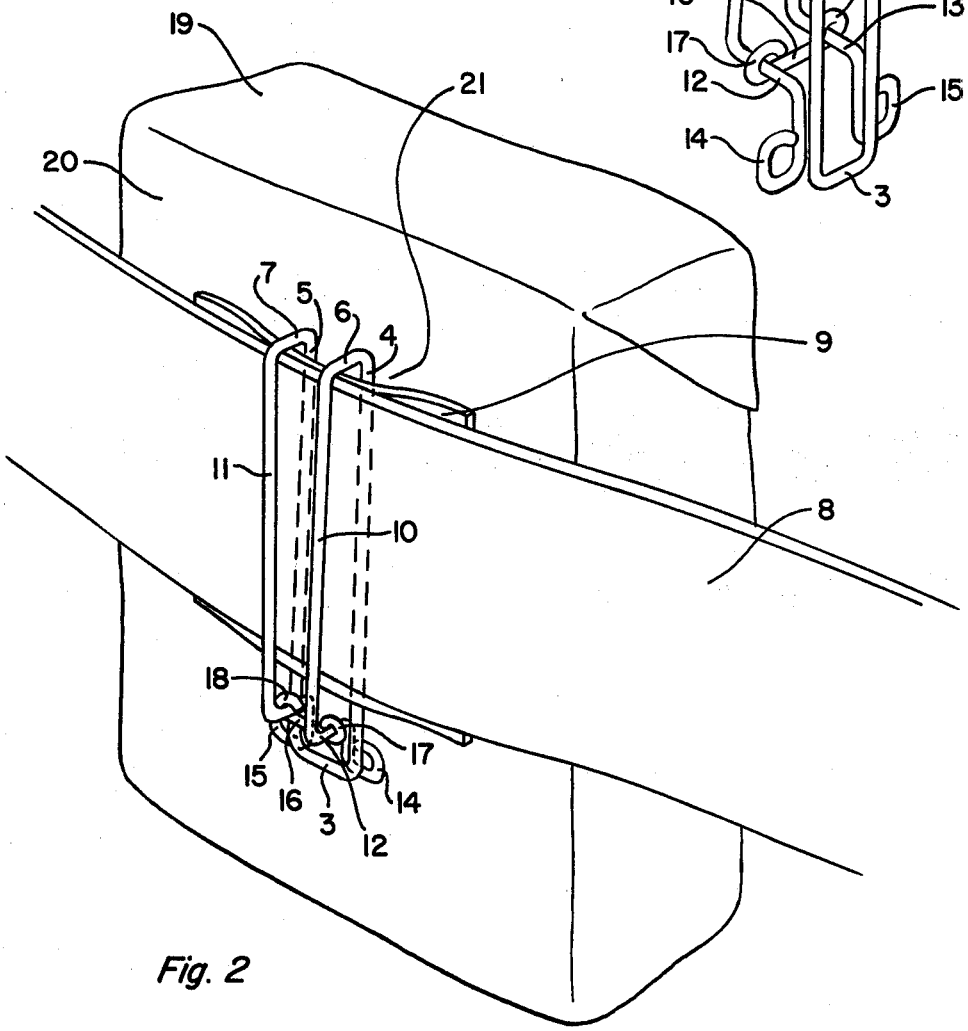

FIG. 1 is a perspective view of a keeper for load carrying equipment in accordance with the invention; and FIG. 2 is a perspective view of the keeper shown in FIG. 1 attached to an article of load carrying equipment and to a service belt and latched in operating condition so as to maintain the load carrying equipment positively attached to the service belt.

Referring to the drawings more specifically, reference numeral 1 indicates a keeper made of metallic wire in accordance with the present invention. Numeral 2 indicates a first elongated segment of resilient metallic wire, and preferably tempered steel wire, bent by means of a wire-bending tool so as to form a base leg 3, which extends equidistantly a suitable length on each side of a point midway between the ends of first segment 2. The length of base leg 3 may be varied, but is preferably about ⅝-inch long in keepers for use with standard military service belts. In the forming of the base leg 3, the wire of first segment 2 is bent upwardly from each end of base leg 3, producing two substantially parallel, spaced apart, upwardly extending arms 4 and 5 which are substantially perpendicular to base leg 3 and which extend upwardly to points equidistant along arms 4 and 5 from base leg 3 where two parallel loops 6 and 7 are formed by bending of the wire of first segment 2. To complete the two loops the wire of first segment 2 is bent downwardly beginning at a suitable distance from arms 4 and 5 so that a service belt 8 and a webbing loop 9 will be accommodated within the two loops 6 and 7 and so that two substantially parallel downwardly extending arms 10 and 11 will be formed. The downward extension of arms 10 and 11 is interrupted by bending the wire of first segment 2 to form two substantially parallel horizontal legs 12 and 13 spaced substantially equidistantly above base leg 3 and constituting offsets of the lower portions of downwardly extending arms 10 and 11 extending generally in the direction of upwardly extending arms 4 and 5. In forming horizontal legs 12 and 13 account must be taken of the width of service belt 8 and webbing loop 9 since they will need to fit between loops 6 and 7 at the top edges thereof and horizontal legs 12 and 13 at the bottom edges thereof or of the wider of the belt and webbing. The wire of first segment 2 is bent in a downward direction again at the ends of horizontal legs 12 and 13 and then formed into ears 14 and 15 oriented in such a manner that they will lie in a plane parallel to the plane in which the two upwardly extending arms 4 and 5 and the base leg 3 lie, but turned in opposite directions one from the other and so that each of ears 14 and 15 will be capable of passing between upwardly extending arms 4 and 5 above base leg 3 when downwardly extending arms 10 and 11 are flexed. Thus, the ears 14 and 15 serve as locking elements for the keeper, as will be more particularly described hereinafter.

A latch 16 is provided for holding the keeper in either a locked condition or an unlocked condition, as may be desirable under varying circumstances. Latch 16 is formed from a second segment of resilient wire, and preferably tempered steel wire, which is appreciably shorter than the first segment of wire. It has a first eye 17 formed at one end thereof and a second eye 18 formed at the other end thereof. The wire of which latch 16 is constructed may be of the same diameter as the wire used for the first segment. However, it may be of smaller diameter, but it is important for each of the eyes 17 and 18 to fit reasonably snugly around the wire of the first segment, but not so snugly as to cause problems in sliding the latch 16 along the horizontal arms 12 and 13 and along the downwardly extending arms 10 and 11 and loops 6 and 7, as further explained hereinafter.

In the use of the keeper of the invention, as more particularly illustrated by FIGS. 1 and 2, when it is desired to secure a load carrying pouch 19 having a webbing loop 9 attached to the back 20 thereof to a service belt 8 by means of a keeper 1, latch 16, as shown in FIG. 1 is slid along horizontal arms 12 and 13, then upwardly along downwardly extending arms 10 and 11 and onto the tops of loops 6 and 7. Downwardly extending arms 10 and 11 are then free to be flexed. Holding latch 16 at the tops of loops 6 and 7, the base leg 3 is inserted in the pocket 21 formed between back 20 and webbing loop 9 and forced downwardly through pocket 21 along with upwardly extending arms 4 and 5 and out of the open bottom of pocket 21 until the lower or inner surfaces of loops 6 and 7 rest against the upper edges of webbing loop 9 and belt 8. The keeper is then in position to be locked in place holding the load carrying pouch suspended on the service belt. Locking of the keeper is accomplished by first flexing one of the downwardly extending arms, such as 10, toward the other downwardly extending arm 11 until ear 14 can pass between upwardly extending arms 4 and 5. Ear 14 is passed between upwardly extending arms 4 and 5 and downwardly extending arm 10 is permitted to snap back, thus bringing ear 14 into a locking position curled about upwardly extending arm 4. Similarly, downwardly extending arm 11 is flexed toward downwardly extending arm 10 until ear 15 can pass between upwardly extending arms 4 and 5; ear 15 is then passed between arms 4 and 5 and arm 11 is permitted to snap back, thus bringing ear 15 into a locking position curled about upwardly extending arm 5. Then latch 16 is moved back along loops 6 and 7, downwardly along downwardly extending arms 10 and 11 and forward toward upwardly extending arms 4 and 5 along horizontal arms 12 and 13 sufficiently to prevent downwardly extending arms to be subsequently flexed and, therefore, to prevent the keeper from becoming unlocked except by design and deliberate movement of latch 16 sufficiently to allow flexing of arms 10 and 11 to be carried out. To remove keeper 1, the above-described steps are simply reversed.

It will be readily seen that the keeper of the invention is a relatively simple, yet very effective and inexpensive device for securing load carrying equipment to the service belts of military personnel and that it could be readily employed with belts or other equipment used by civilians as well as military personnel.

It will be understood that various changes in the details, materials and arrangements of parts which have been herein described and illustrated in order to explain the nature of the invention, may be made by those skilled in the art within the principle and scope of the invention.

I claim:

1. A keeper for detachably securing load carrying means to a service belt designed to be worn about the waist of a military person which comprises:

(a) a first elongated segment of resilient metallic wire of sufficient diameter and strength to resist being permanently bent out of its normal physical shape during the normal use of said keeper, said first segment of metallic wire being forcefully bent by means of a wire-bending tool to form therein a base leg extending approximately equidistantly a suitable distance on both sides of a point equidistant from the two free ends of said first segment of metallic wire, two substantially parallel, spaced apart, upwardly extending arms perpendicular to said base leg, two substantially parallel spaced apart loops to fit over the top of said service belt, said loops being formed as continuations of said upwardly extending arms, two substantially parallel, spaced apart, downwardly extending arms formed as continuations of said two spaced apart loops, each of said downwardly extending arms having a horizontal leg formed therein, said horizontal legs being substantially parallel to each other and spaced equidistantly above said base leg, each of said horizontal legs forming an offset of the lower portion of one of said downwardly extending arms extending generally in the direction of said upwardly extending arms, the lower portions of said downwardly extending arms being bent to form an ear at each of the two ends of said first elongated segment of metallic wire, each of said ears being located at a height above said base leg and being of a diameter and oriented in a direction such as to permit it to pass between said two upwardly extending arms when said downwardly extending arm on which it is formed is flexed inwardly with respect to said upwardly extending arms, whereby when each of said ears has passed between said upwardly extending arms, and when said downwardly extending arm is released, said keeper becomes locked; and (b) a latching means for maintaining said downwardly extending arms in their locked positions, said latching means being formed from a second segment of resilient metallic wire, each of the two ends of said second segment of metallic wire having an eye formed therein, the metallic wire forming each of said eyes surrounding the wire of the horizontally formed legs and the downwardly extending arms, said latching means being freely slidable along said horizontally formed legs, said downwardly extending arms, and said loops to latch or to unlatch said keeper when said ears are in their locking positions.

2. A keeper according to claim 1, wherein said first elongated segment of metallic wire is made of tempered steel wire.

3. A keeper according to claim 1, wherein both said first elongated segment of metallic wire and said latching means are made of tempered steel wire.

* * * * *